US006234798B1

(12) United States Patent
Beals et al.

(10) Patent No.: US 6,234,798 B1
(45) Date of Patent: May 22, 2001

(54) FLEXIBLE TIP TOOTHBRUSH HANDLE

(75) Inventors: Donna Beals, Sunnyvale; Max Yoshimoto, San Francisco; Jeffrey Allen Salazar, Belmont; William A. Bredall, Pacifica; Thomas Craig Masterman, Foster City, all of CA (US)

(73) Assignee: Gillette Canada Inc., Kirkland (CA)

( * ) Notice: Subject to any disclaimer, the term of this patent is extended or adjusted under 35 U.S.C. 154(b) by 0 days.

(21) Appl. No.: 09/428,809

(22) Filed: Oct. 28, 1999

Related U.S. Application Data

(63) Continuation of application No. 09/036,379, filed on Mar. 6, 1998, now abandoned.

(51) Int. Cl.[7] ..... A46B 5/02; A61C 17/00

(52) U.S. Cl. ..... 433/216; 15/143.1; 15/167.1

(58) Field of Search ..... 15/143.1, 167.1; 433/216

(56) References Cited

U.S. PATENT DOCUMENTS

D. 142,917 * 11/1945 Strieby ..... 15/167.1
1,421,098 * 6/1922 Phillips ..... 15/153.1
1,657,450 * 11/1928 Barnes ..... 15/167.1
1,899,242 * 2/1933 McNab ..... 15/167.1
2,263,885 * 11/1941 McGauley ..... 15/167.1
2,267,670 * 12/1941 Rosenwasser ..... 15/167.1
5,630,244 * 5/1997 Chang ..... 15/167.1
5,781,958 * 7/1998 Messmann ..... 15/167.1

FOREIGN PATENT DOCUMENTS

2840429 * 3/1980 (DE) ..... 15/143.1
2050156 * 1/1981 (GB) ..... 15/143.1
2167995 * 6/1986 (GB) ..... 15/167.1
226526 * 5/1969 (SE) ..... 15/143.1

* cited by examiner

*Primary Examiner*—Randall E. Chin
(74) *Attorney, Agent, or Firm*—Fish & Richardson P.C.

(57) ABSTRACT

A toothbrush comprising a handle member affixed to a flexible extension which is grippable by the user so that the flexible end is in contact with the heel of the palm of the user to flex when force is applied by the user to the head of the toothbrush. Rubberized inserts are also provided on the handle of the toothbrush to provide improved gripping surfaces for the fingers and palm of the user.

15 Claims, 1 Drawing Sheet

FLEXIBLE TIP TOOTHBRUSH HANDLE

This application is a continuation of U.S. application Ser. No. 09/036,379, filed Mar. 6, 1998, now abandoned.

BACKGROUND OF THE INVENTION

Invention relates to toothbrushes and, in particular, to toothbrushes having an ergonomically designed handle.

There is an ongoing endeavor in the art to design toothbrushes which are more effective, easier to use, or more comfortable. An example is U.S. Pat. No. 4,672,706 which discloses a handle of rectangular cross section twisted about its longitudinal axis to fit into the palm of a person's hand. However, the handle is essentially straight and made of a hard material.

In PCT application WO 96/21400, published Jan. 10, 1995, there is disclosed a toothbrush having a curved end which is separately rotatable with respect to the portion of the handle accommodating the brush.

SUMMARY OF THE INVENTION

The present invention provides an improved toothbrush having a handle which is advantageous in providing good comfort to the palm of the hand when applying force at the end of the toothbrush.

In one aspect, the invention features a toothbrush comprising a handle member and a head member fixed to the proximal end of the handle member. The handle member is rigid at the proximal end that terminates with a head member comprising flexible bristles. The handle member is grippable by the user so that the flexible distal end in contact with the heel of the palm of the user may flex when force is applied by the user to the head member. The distal end is made of a flexible material, such as rubber, so that it will flex when pressure is applied. The flexible distal end is also easily gripped when made of a rubber material.

In another aspect, there are inserts on the handle member which are also made of a rubber material to facilitate the gripping of the handle between the thumb and index finger. Thus, the important areas of contact of the hand with the brush, which comprise the thumb, index finger and heel of the palm, are all in contact with a corresponding rubber portion on the brush handle member.

Other features and advantages of the invention will be apparent from the description of the preferred embodiment and from the claims.

DESCRIPTION OF THE PREFERRED EMBODIMENT

Figure 1:
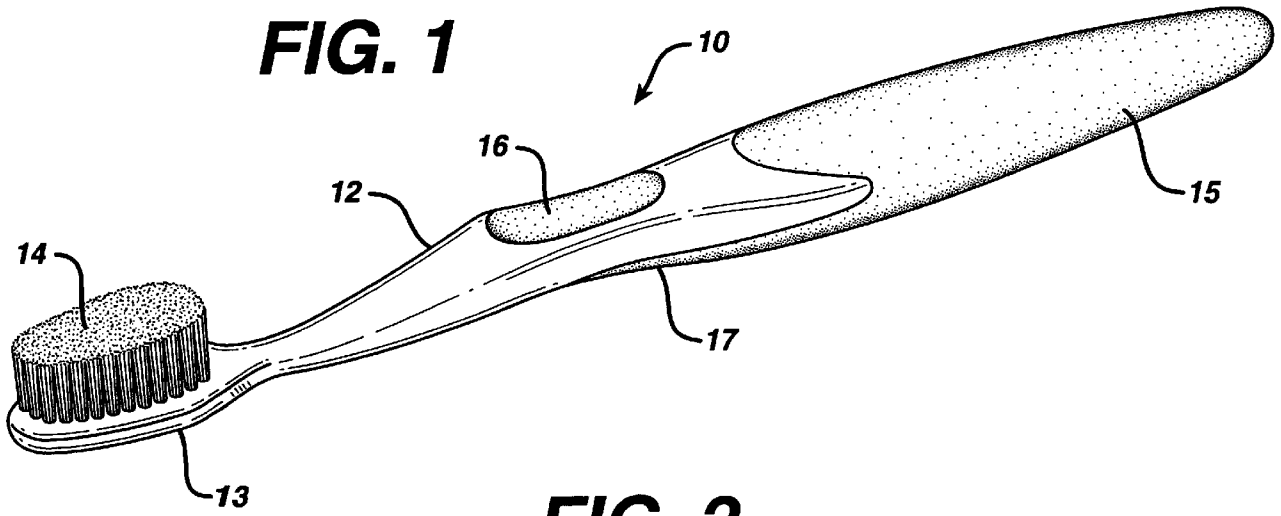
FIG. 1 is a perspective view of an embodiment of are toothbrush of the invention.

Referring to FIG. 1, a toothbrush (10) includes a plastic body having a handle (12) and a head (13) to which is attached a bristle portion (14).

The body of the toothbrush is formed by conventional methods well known in the art. The handle is shaped to be grasped by a hand. The configuration of the head (13) may vary and may be rectangular, oval, diamond shaped, or any other suitable shape, with bristles which are trimmed flat, serrated, V-shaped, convex, or any other desired tooth geometry as is well known in the art. The portion of the handle (12) adjacent to the head (13) forms a neck of smaller circumferential dimension than the remainder of the handle. The shape and size of the handle (12) and head (13) may vary and the axes of the handle and head may be on the same or different plane. The distal end of the handle is affixed to a flexible portion (15) extending beyond the distal end and made of a rubberized material to assist in the gripping of the toothbrush. The flexible portion is oval in cross-section for added comfort and security for gripping. There is also a rubberized insert (16) located approximately at the midpoint of the handle, which is also made of a rubberized material and is intended to accommodate the index finger of the holder. On the opposite side of the handle from the insert (16), there is a rubberized portion (17) which is an extension of the rubberized distal end (15). The portion (17) is intended to accommodate the thumb of the user when gripping the toothbrush.

Figure 2:
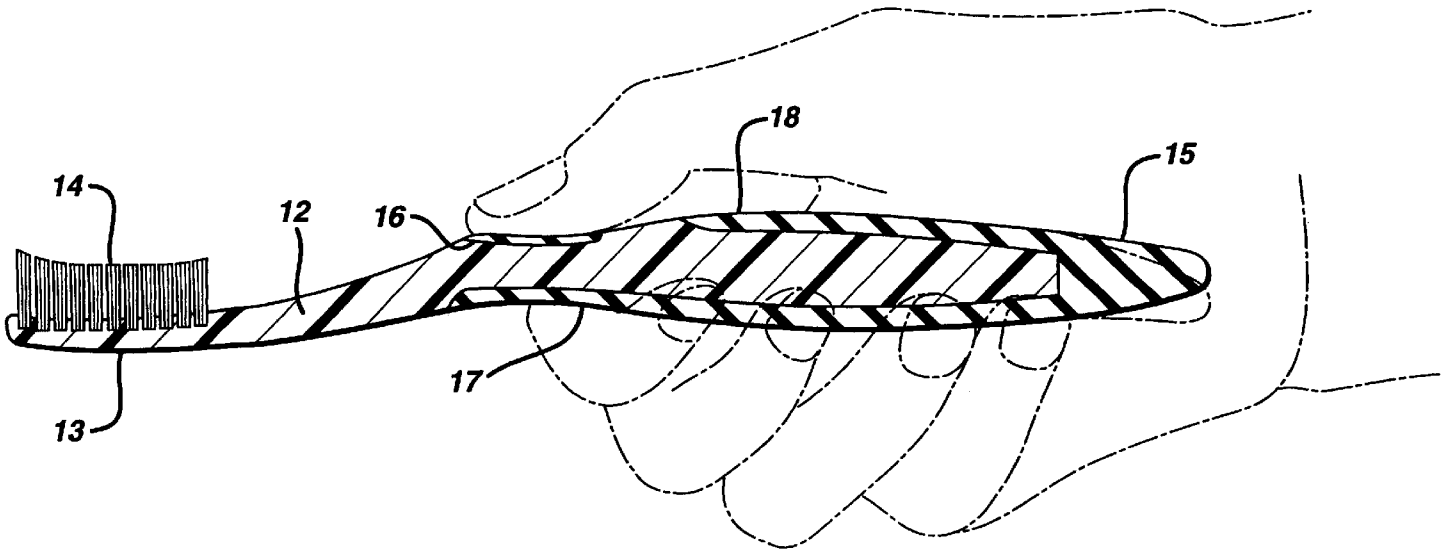
FIG. 2 is a partial cross-sectional view of an embodiment of a toothbrush of the invention showing, in silhouette, the hand of the user.

Referring to FIG. 2, there is shown a partial cross-section of the toothbrush (10) being held, in silhouette, by a user. The handle (12) is shown to accommodate the bristle portion (14) at its proximal end. At the distal end, it forms a core surrounded by the flexible portion (15). The handle (12), however, either does not extend all the way to the tip of the flexible portion (15) as a core or has a core that is thin enough to be flexible in one or more directions. The rubberized surface of the distal end extends toward the midpoint of the handle to form inserts (17) and (18) which are flush with the surface of the handle (12). This forms areas of contact within the palm of the hand for a more secure grip. The insert (16) is also shown which is placed approximately mid-point on the handle (12) and in a location where it can accommodate either the thumb or index finger of the holder, depending on which way the bristles (14) are pointed. The rubberized, flexible portions 15, 16, 17 and 18 are preferably a thermoplastic elastomer (TPE). A typical useful elastomer is kraton rubber (a hydrogenated or unhydrogenerated oil-filled block copolymer of styrene and butadiene or isoprene having a shore A hardness in the range of about 5 to about 95. Other suitable materials include injection or reactive injection molded foams, rubber vulcanates and silicone vulcanates.

An advantage of the present invention is that when by gripping the handle (12) and/or by applying force at the head (13) against the interior of the oral cavity, an opposite force is applied at the distal end of the toothbrush against the heel of the hand of the user. The flexible distal end not only eases the pressure of an otherwise hard surface against the hand but also flexes to accommodate the curvature of the heel of the hand. Accordingly, the toothbrush is ergonomically comfortable to the user.

It should be readily apparent to those of skill in the art that the foregoing is by way of example to represent the preferred embodiment of the invention. It is possible to modify the arrangement of the components somewhat and still achieve the desired features. Therefore, it is clear that the present invention may be embodied in other specific forms without departing from the essential inventive elements.

What is claimed is:

1. A toothbrush comprising:

a body and a brush head extending from the body, wherein the body comprises a handle having a distal end, a first resilient element mounted on the handle, a tapered distal tip of the first resilient element extending unsupported beyond the distal end of the handle, and a second resilient element constructed to provide a grip for a user's thumb and index finger during use.

2. The toothbrush of claim 1 wherein the body is contoured to provide a finger-gripping region, and a palm-gripping region having a relatively larger diameter than the finger-gripping region.

3. The toothbrush of claim 2 wherein the thermoplastic elastomer has a Shore A hardness of from about 5 to 95.

4. The toothbrush of claim 2 wherein the body has a contoured thickness that is largest at the approximate midpoint between the finger-gripping region and the distal end of the handle.

5. The toothbrush of claim 1 wherein the first resilient element comprises a thermoplastic elastomer.

6. The toothbrush of claim 1 wherein said distal tip is generally oval in cross-section.

7. The toothbrush of claim 1 wherein said first resilient element provides a gripping surface for the palm of a user's hand during use.

8. A toothbrush comprising:

a body, a brush head extending from the body, and a neck between the body and the brush head, wherein the body comprises a handle having a distal end, a first resilient element mounted on the handle, a distal tip of the first resilient element extending unsupported beyond the distal end of the handle, and a second resilient element constructed to provide a grip for a user's thumb and index finger during use, the body having a maximum circumference at a location intermediate the neck and the distal end, and tapering to a relatively smaller circumference at the neck and distal end.

9. A toothbrush comprising:

a body and a brush head including bristles extending from the body, wherein the body comprises a handle having a distal end, a first resilient element comprising a thermoplastic elastomer mounted on the handle, a tapered distal tip of the resilient element extending unsupported beyond the distal end of the handle, said distal tip being generally oval in cross-section, and a second resilient element constructed to provide a grip for the user's thumb and index finger; and wherein the body is contoured to provide a finger-gripping region, and a palm-gripping region having a relatively larger diameter than the finger-gripping region, the thickness of the body, in a direction parallel to the bristles, being largest at the approximate midpoint between the finger-gripping region and the distal end of the handle.

10. A method of cleaning human teeth comprising brushing the teeth with a toothbrush that includes a body and a brush head extending from the body, wherein the body comprises a handle having a distal end, a first resilient element mounted on the handle, a tapered distal tip of the resilient element extending unsupported beyond the distal end of the handle, and a second resilient element constructed to provide a grip for a user's thumb and index finger during use.

11. A toothbrush comprising:

a body and a brush head extending from the body, wherein the body comprises a handle having a distal end, and a resilient element mounted on the handle, a tapered distal tip of the resilient element extending unsupported beyond the distal end of the handle;

wherein the body is contoured to provide a finger-gripping region, and a palm-gripping region having a relatively larger diameter than the finger-gripping region, the body having a contoured thickness that is largest at the approximate midpoint between the finger-gripping region and the distal end of the handle.

12. The toothbrush of claim 11 wherein the resilient element comprises a thermoplastic elastomer.

13. The toothbrush of claim 12 wherein the thermoplastic elastomer has a Shore A hardness of from about 5 to 95.

14. The toothbrush of claim 11 wherein said distal tip is generally oval in cross-section.

15. A method of cleaning human teeth comprising brushing the teeth with a toothbrush that includes a body, a brush head extending from the body, and a neck between the body and the brush head, wherein the body comprises a handle having a distal end, and a resilient element mounted on the handle, a tapered distal tip of the resilient element extending unsupported beyond the distal end of the handle, the body being contoured to provide a finger-gripping region, and a palm-gripping region having a relatively larger diameter than the finger-gripping region, the body having a thickness that is largest at the approximate midpoint between the finger-gripping region and the distal end of the handle.

* * * * *

UNITED STATES PATENT AND TRADEMARK OFFICE

CERTIFICATE OF CORRECTION

PATENT NO. : 6,234,798 B1
DATED : May 22, 2001
INVENTOR(S) : Donna Beals, William A. Bredall, Max Yoshimoto, Thomas Craig Masterman and Jeffrey Allen Salazar It is certified that error appears in the above-identified patent and that said Letters Patent is hereby corrected as shown below:

Title page, Column 2,
Item [56] References Cited,
1,421,098 delete [153.1] and insert -- 143.1 --
1,657,450 delete [11/1928] and insert -- 1/1928 --

Signed and Sealed this

Fifth Day of March, 2002

*Attest:*

*Attesting Officer*

JAMES E. ROGAN
*Director of the United States Patent and Trademark Office*